US010265840B2

(12) United States Patent
Anstett et al.

(10) Patent No.: US 10,265,840 B2
(45) Date of Patent: Apr. 23, 2019

(54) ADJUSTABLE FASTENER-DRIVING TOOL SUPPORT SYSTEM

(71) Applicant: Powernail Company, Lake Zurich, IL (US)

(72) Inventors: Todd J. Anstett, Island Lake, IL (US); David A. Anstett, Kildeer, IL (US); Maxwell D. Anstett, Kildeer, IL (US)

(73) Assignee: Powernail Company, Lake Zurich, IL (US)

( * ) Notice: Subject to any disclaimer, the term of this patent is extended or adjusted under 35 U.S.C. 154(b) by 977 days.

(21) Appl. No.: 14/536,742

(22) Filed: Nov. 10, 2014

(65) Prior Publication Data

US 2016/0129573 A1 May 12, 2016

(51) Int. Cl.
*B25C 7/00* (2006.01)
*E04F 21/22* (2006.01)

(52) U.S. Cl.
CPC ..... *B25C 7/00* (2013.01); *E04F 21/22* (2013.01)

(58) Field of Classification Search
CPC ... E04F 21/22; B25C 7/00; B25C 1/04; B27F 7/02

(Continued)

(56) References Cited

U.S. PATENT DOCUMENTS 2,822,544 A * 2/1958 Anstett ..... B25C 3/002 227/147
3,012,247 A * 12/1961 Sillars ..... B25C 3/002 227/121

(Continued)

FOREIGN PATENT DOCUMENTS

WO 2007124555 11/2007

OTHER PUBLICATIONS

Bostitch nailer. Four photographs. Date: Jun. 2014.

(Continued)

*Primary Examiner* — Andrew M Tecco
*Assistant Examiner* — Nicholas Igbokwe
(74) *Attorney, Agent, or Firm* — Jansson Munger McKinley & Kirby Ltd.

(57) ABSTRACT

An adjustable fastener-driving tool support system. The support system supports the fastener-driving tool on a top surface of a flooring element to repeatably drive fasteners at a consistent position and angle into either a tongue side or a groove side of the flooring element. A support system includes an elongate channel member, a base and a holder mechanism. A guide member secured with respect to the channel member may also be provided. The base is configured to rest on the top surface of the flooring element to support the channel member at a downward angle with a driving end fastener outlet extending below a bottom surface of the base. Movement of the base along the channel raises or lowers the driving end fastener outlet and guide member so that the guide member can contact the flooring element during fastener driving to support the tool and so that the driving end fastener outlet is positioned relative to the flooring element for fastener driving. The holder mechanism holds the base against the channel member at any one of a plurality of axial positions along the channel member to provide for the repeatable driving of the fasteners at a consistent position and angle.

26 Claims, 12 Drawing Sheets

(58) Field of Classification Search
USPC ..... 227/120, 127, 148; 411/450
See application file for complete search history.

(56) References Cited

U.S. PATENT DOCUMENTS

| | | | | |
|---|---|---|---|---|
| 3,281,046 | A * | 10/1966 | Boulay | B25C 3/002 227/109 |
| 3,360,176 | A | 12/1967 | Gehl et al. | |
| 4,470,531 | A | 9/1984 | Anstett | |
| 4,621,758 | A | 11/1986 | Anstett | |
| 4,657,166 | A | 11/1987 | Anstett | |
| 4,706,867 | A | 11/1987 | Anstett | |
| 5,180,091 | A | 1/1993 | Ota | |
| 5,261,588 | A * | 11/1993 | Lin | B25C 7/00 227/110 |
| 5,628,445 | A * | 5/1997 | Braddock | B25C 7/00 227/120 |
| 5,649,660 | A | 7/1997 | Akiba et al. | |
| 5,934,539 | A | 8/1999 | Lee | |
| 6,119,912 | A * | 9/2000 | Peck | B25C 7/00 173/20 |
| 6,318,620 | B1 * | 11/2001 | Anstett | B25C 1/005 227/147 |
| 6,631,836 | B2 | 10/2003 | Dickhaut | |
| 6,789,718 | B2 | 9/2004 | Canlas et al. | |
| 6,843,402 | B2 | 1/2005 | Sims et al. | |
| 7,051,914 | B2 | 5/2006 | Herelier | |
| 7,055,728 | B2 | 6/2006 | Lin | |
| 7,255,256 | B2 | 8/2007 | McGee et al. | |
| 7,344,057 | B2 * | 3/2008 | Dion | B25C 7/00 227/8 |
| 7,419,078 | B2 | 9/2008 | Hamar | |
| 7,882,994 | B2 | 2/2011 | Francescon | |
| 7,886,950 | B2 | 2/2011 | Lin et al. | |
| 8,387,846 | B2 | 3/2013 | Francis et al. | |
| 8,827,132 | B2 * | 9/2014 | Mina | B25C 7/00 227/148 |
| 2005/0145670 | A1 * | 7/2005 | Huang | B25C 7/00 227/148 |
| 2007/0057013 | A1 * | 3/2007 | Deziel | B25C 1/02 227/147 |
| 2008/0296341 | A1 * | 12/2008 | Francescon | B25C 7/00 227/119 |
| 2009/0266867 | A1 | 10/2009 | Mina et al. | |

OTHER PUBLICATIONS

Duo Fast nailer instructions. Date: Jun. 2014.
Freeman nailer. Three photographs. Date: Jun. 2014.
Primatech nailer. Five photographs. Date: Jun. 2014.
Powernail Model 50P Flex nailer product specification sheet, 1 p., Date: Dec. 2013.
Powernail Model 50P nailer product specification sheet, 1 page. Date: Apr. 2015.
Powernail Model 50M Flex nailer product specification sheet , 1 page. Date: Dec. 2013.
Powernail Model 45/45R nailer product specification sheet, 1 page. Date: Oct. 2013.
Powernail Model 200 nailer product specification sheet, 1 page. <http://www.powernail.com/products/model-200/> Date: unknown.
Powernail Model 2000 nailer product specification sheet, 1 page. Date: Oct. 2013.

* cited by examiner

ADJUSTABLE FASTENER-DRIVING TOOL SUPPORT SYSTEM

FIELD

The field relates to fastener-driving tools and, more specifically, to support systems for positioning the fastener-driving tool relative to a workpiece.

BACKGROUND

Building materials, such as flooring elements, are commonly provided with what is known as a "tongue-and-groove" design configuration. A tongue-and-groove configuration consists of a tongue which extends out from one side of the flooring element and a groove formed in the opposite side of the flooring element. The tongue-and-groove configuration is provided to connect adjacent flooring elements together on a subfloor with the flooring elements aligned and the tongue of one flooring element received in the groove of the adjacent flooring element.

Before the tongue and the groove of adjacent flooring elements are connected, a fastener is first driven through the tongue side of the flooring element to secure the flooring element to the subfloor. The fastener is typically driven at a 45° angle into a "pocket" formed at the junction of the tongue and the side wall of the flooring element. A fastener-driving tool, such as a powered pneumatic nailer or stapler, is routinely used to drive the fastener through the flooring element and into the subfloor. This type of fastening is frequently referred to as a "blind" fastening process because the fastener is hidden and covered when the tongue of the fastened flooring element is received in the groove of the adjacent flooring element.

Flooring elements with a tongue-and-groove design configuration are provided in many different shapes and sizes. Flooring elements with a width of about 5 inches or greater are generally referred to as "planks" while flooring elements with a width of 5 inches or less are typically referred to as "strips." As can be appreciated, many flooring elements are typically required to cover a subfloor in any given flooring installation. As can also be appreciated, many fasteners are required to secure such flooring elements to the subfloor. It is important to the finished appearance of the flooring installation (e.g., uniformity of surface appearance and joint lines between adjacent flooring elements) that the fasteners are repeatably driven into the flooring elements at a consistent position and angle. It is also important that the fastener-driving tool used to drive the many fasteners do so in an accurate and efficient manner.

Increasingly, flooring elements are being made of what are referred to as "engineered materials" and flooring elements made of such engineered materials may not be capable of being fastened to a subfloor using conventional techniques and fastener-driving tools. For example, engineered flooring elements may be of a laminate construction comprising an engineered substrate with a veneer overlying the substrate. The veneer can provide the appearance of a solid wood flooring element or can provide any other design. The veneer may be of wood or another material.

The engineered substrate to which the veneer is laminated may be of a variety of different materials. Representative examples of engineered materials utilized as a flooring element substrate are medium-density fiberboard (MDF), high-density fiberboard (HDF) and laminated plywood.

Flooring elements made of engineered materials are frequently manufactured to have a tongue-and-groove design configuration providing an interlocking or "snap-fit" connection between adjacent flooring elements. The snap-fit connection is provided by tongue and groove elements which are keyed to fit together and to provide the interlocking connection. Complex tongue and groove configurations can be provided to provide the interlocking connection.

Flooring elements made of engineered materials tend to be thin relative to conventional natural solid wood flooring elements. An engineered flooring element may have a thickness ranging from about 0.312 inch to about 0.625 inch which is less than the 0.750 inch thickness typical of a natural solid wood flooring element.

The tongues of these relatively thin flooring elements of engineered materials also tend to be less thick and long as the tongue of a natural solid wood flooring element. Such tongues can be insufficiently robust to receive a fastener without tearing or failure. Therefore, it could be desirable to drive a fastener into the groove side of the flooring element. However, existing fastener-driving tools which rest on the subfloor next to the flooring element being fastened can be obstructed from proper fastener-driving placement against the groove side of the flooring element by either the horizontal walls forming the groove or by complex vertical ribs or other structure forming the snap-fit configuration of the groove.

Because flooring elements generally are provided in different thicknesses, the spacing between the top surface of the flooring element and the tongue and/or the groove on the respective sides of the flooring element can vary greatly. It is important that the fastener-driving tool be capable of quick and easy adjustment to raise or lower the fastener driver to drive a fastener into the desired location of the flooring element and that the adjustment mechanism be sufficiently robust to remain in position throughout repeated fastener-driving cycles.

It would be an improvement in the art to provide an improved fastener-driving tool support system which would support a fastener-driving tool to repeatably drive fasteners at a consistent position and angle into a flooring element, which would be capable of repeatably driving fasteners at a consistent position and angle into either the tongue side or groove side of a flooring element notwithstanding potential obstructions provided by the flooring element, which would be capable of rapid and simple adjustment to position the fastener-driving tool to drive a fastener at the desired location on flooring elements provided across a range of different thicknesses and design configurations, which would be robust and would maintain the position of the fastener-driving tool through many fastener-driving cycles without need for adjustment and which would be simple to use and economical to manufacture.

SUMMARY

Adjustable fastener-driving tool support systems are disclosed herein. The support systems are configured to position a fastener-driving tool on the top surface of a flooring element to repeatably drive fasteners at a consistent position and angle to secure the flooring element to a subfloor. An application for the support systems may be in connection with driving fasteners into tongue-and-groove type flooring elements because the support systems can position the fastener-driving tool to drive fasteners into either a tongue side or a groove side of the flooring element.

In a preferred embodiment, the support system comprises an elongate channel member, a base for supporting the tool on the flooring element and a holder mechanism. Most preferably, a guide member is provided as a component of the support system.

In an embodiment, the elongate channel may be provided with forward and rearward ends and defines an axis. The channel member has an elongate magazine and supports a fastener driver and a driving end fastener outlet proximate the forward end of the channel member. Fasteners in the magazine of the channel member are fed to the driver.

In an embodiment, the base supports the channel member at a downward angle, which may be about a 45° angle, so that fasteners driven from the driving end fastener outlet are driven at about a 45° angle into the flooring element and subfloor. An example of a base may include forward and rearward ends, a bottom surface defining a plane and a top surface angled downward relative to the bottom surface toward the base forward end. The base supports the channel member at the downward angle with the driving end fastener outlet below the bottom surface plane.

In an embodiment, the base may be axially movable to a plurality of axial positions along the channel member to raise or lower the driving end fastener outlet with respect to the base bottom surface. This arrangement allows the driving end fastener outlet to be lowered onto a tongue or into a groove of the flooring element avoiding obstructions such as the top wall defining the groove or upright ribs found in tongue-and-groove flooring elements of a snap-fit type.

In one embodiment, the channel member may be supported by the base by means of an axial track on the channel member and an engager along the base top surface in engagement with the track. As an example, the track may be the first and second opposite outer sides of the channel member. In such embodiment, the engager may include a pair of spaced apart inwardly-facing retainers and a support surface therebetween. The support surface supports the channel member and the inwardly-facing retainers cause the channel member and base to move relatively axially with non-axial movement of the base and channel being limited.

The guide member may be provided for supporting the fastener-driving tool on the flooring element during fastener driving to provide a second point of contact with the flooring element to support and stabilize the fastener-driving tool during fastener driving. In an embodiment, the guide member may be secured with respect to the channel member forward end with a guide member support surface positioned below the base bottom surface so that the support surface can be lowered onto the tongue or into the groove along with, and in alignment with, the driving end fastener outlet to provide the second point of contact with the flooring element.

In embodiments, the guide member may guide the fastener during driving. In such embodiments, the guide member may define a gate opening into which fasteners are fed from the magazine. A gate plate supported by the guide member may be provided to close a forward end of the gate opening to thereby act as a wall against which a forwardmost fastener is pushed from the magazine and into position for the fastener driving.

In such embodiments, the guide member support surface may include the driving end fastener outlet and such outlet is in axial alignment with the gate opening. Just before the fastener driving event, the guide member support surface and driving end fastener outlet may be pushed by a user against the flooring element. A drive blade of the driver then drives a fastener in the gate opening out of the guide member through the driving end fastener outlet and into the flooring element. Since the support surface and driving end fastener outlet are accurately set against the flooring element, the fastener is driven at the desired position and angle.

The gate plate may also be used to operate a safety mechanism enabling fastener-driver tool operation. In such embodiments, the gate plate may move between a first position extending past the guide member support surface and a second position in alignment with the guide member support surface such that movement to the second position acts on a safety mechanism to enable operation of the fastener-driving tool.

To improve positioning of the guide member support surface on a tongue or in a groove and to clear obstructions such as walls defining the groove or an upright rib proximate the groove, guide member embodiments may be tapered. A taper may reduce a thickness dimension of the guide member and the taper may be proximate the guide member support surface to allow the guide member support surface to clear obstructions. In embodiments, top and bottom surfaces of the guide member may be tapered.

In an embodiment, the holder mechanism may releaseably hold the base against the channel member at any one of the plurality of axial positions. Holding of the base against the channel member with the base on the top of the flooring element enables the driving end fastener outlet and guide member to be at a position so that fasteners are driven at the consistent position and angle at which the support system is set by the user.

An example of a holder mechanism capable of use with the support system may include an elongate track along the channel member, a retainer nut, a threaded member which meshes with the retainer nut and a lever which turns the threaded member. In such embodiment, the retainer nut slides axially within the track as the base moves along the channel member. The threaded member is inserted through a base support surface supporting the channel member and moves with the base. Turning the threaded member with the lever in one direction tightens the threaded member meshed with the retainer nut to apply a force which holds the channel member tightly against the support surface of the base thereby positioning the channel member and base at a desired position. Turning the threaded member with the lever in an opposite direction lessens or releases the force to permit the axial movement of the base along the channel member for positioning of the fastener-driving tool with respect to the flooring element.

Other aspects and embodiments of adjustable fastener-driving tool support systems are described and illustrated herein.

BRIEF DESCRIPTION OF THE DRAWINGS

Exemplary adjustable fastener-driving tool support systems may be understood by reference to the following description taken in conjunction with the accompanying drawings, in which like reference numerals identify like elements throughout the different views. The drawings are not necessarily to scale, emphasis instead being placed upon illustrating the principles of the invention. The drawings depict only embodiments of the invention and are not therefore to be considered as limiting the scope of the invention. In the accompanying drawings.

DETAILED DESCRIPTION

Figure 1:
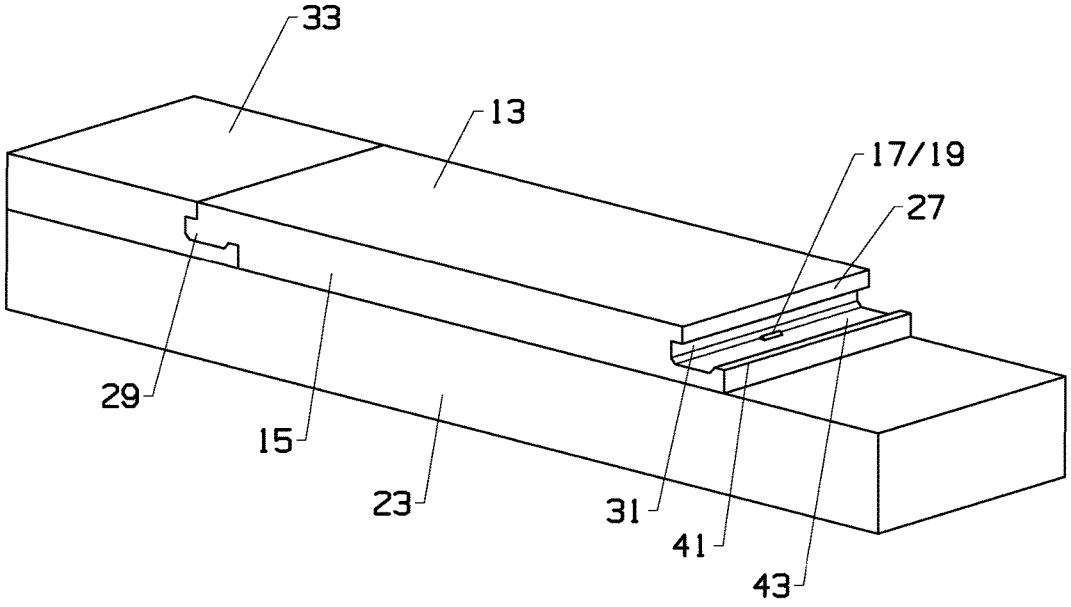
FIG. 1 is a perspective view of tongue-and-groove flooring elements of a snap-fit type on a subfloor.

Referring to the drawings, FIGS. 5-14 illustrate an embodiment of an adjustable fastener-driving tool support system 10 for a fastener-driving tool 11. For convenience and brevity, adjustable fastener-driving tool support system 10 is referred to herein simply as a support system 10. Support system 10 is capable of supporting fastener-driving tool 11 on a top surface 13 of a flooring element 15, which may be of a tongue-and-groove type such as illustrated in FIGS. 1-3, 6 and 12-14.

Figure 4B:
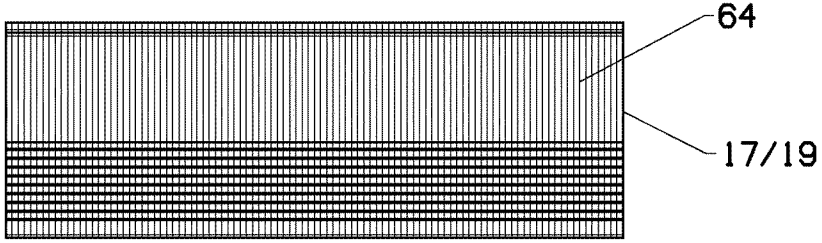
FIGS. 4A-4C illustrate fastener embodiments.
Figure 4C:
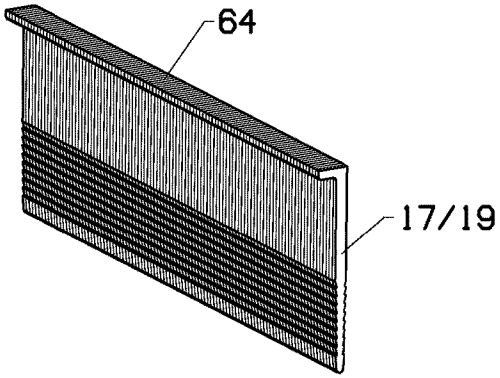
Figure 4A:
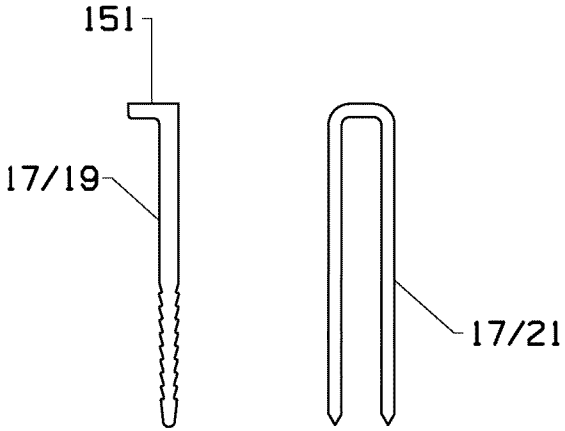

Support system 10 of the examples provides the capability to position fastener-driving tool 11 to repeatably drive fasteners 17, such as a cleat 19 or a staple 21 illustrated in FIG. 4A, into flooring element 15 and subfloor 23 at a consistent position and angle on the tongue side 25 and/or the groove side 27 of the flooring element 15. As discussed below, this capability exists because support system 10 enables the fastener-driving tool 11 to avoid obstructions provided by the flooring element 15. Support system 10 of the examples is simple to adjust and can maintain the position of the fastener-driving tool 11 through many fastener-driving cycles.

Figure 13:
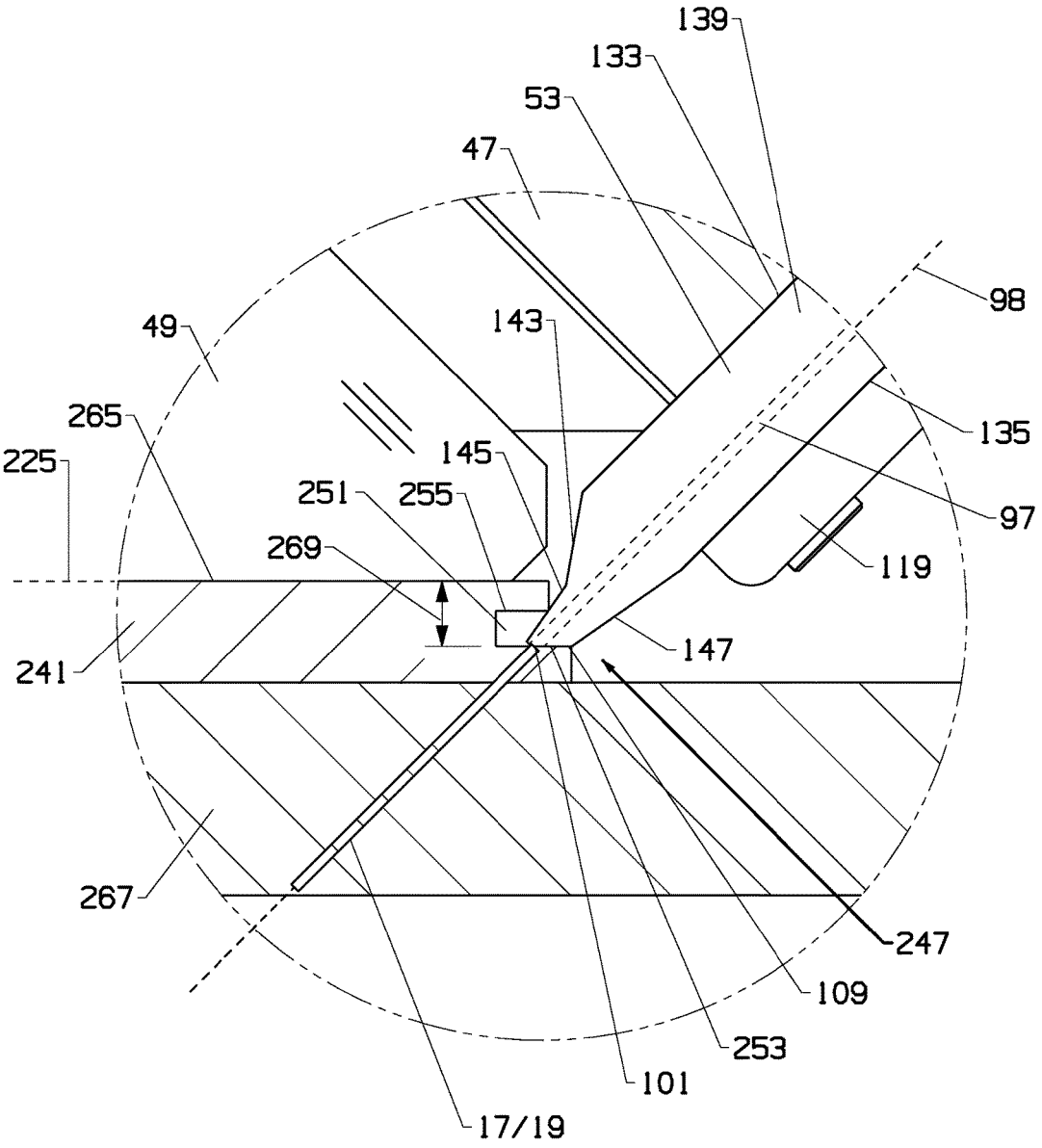
Figure 14:
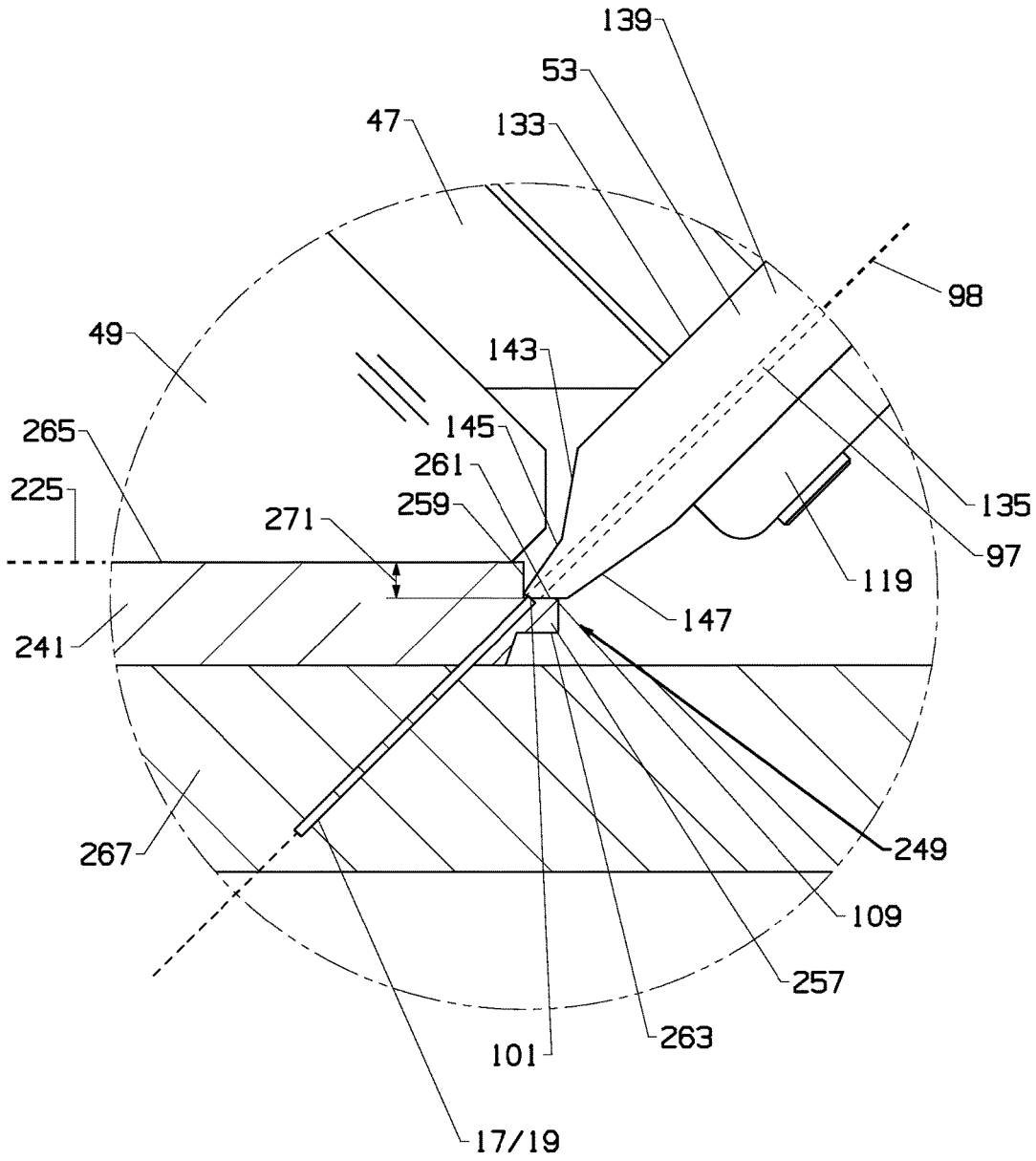

Referring to FIGS. 1-3 and 12, an example of a tongue-and-groove flooring element 15 is illustrated. Flooring element 15 of FIGS. 1-3 and 12 is an example of an interlocking or "snap-fit" type tongue-and-groove design configuration. Persons of skill in the art will appreciate that flooring element 15 is merely an example and that tongue-and-groove flooring elements are available in configurations other than as illustrated in FIGS. 1-3, 6 and 12. For example, FIGS. 13-14 illustrate a more conventional tongue-and-groove flooring element 241. Flooring element 15 is merely representative and could be configured as a plank, as a strip or in other configurations such as parquet configurations.

In the examples, flooring element 15 is formed with a tongue 29 on a tongue side 25 and a groove 31 formed on the opposite, or groove side 27. Flooring element 15 is positioned on a subfloor 23 such that tongue 29 of flooring element 15 is received in groove 31 of adjacent flooring element 33.

An advantage of support system 10 is that it can be used to position fastener-driving tool 11 to drive a fastener 17 into either or both of the tongue side 25 or the groove side 27 of the flooring element 15. This differs from conventional flooring installation practice in which the fastener 17 is driven into just the tongue side of a tongue-and-groove flooring element (e.g., flooring element 241 FIG. 14) to secure the flooring element to a subfloor 23.

Figure 2:
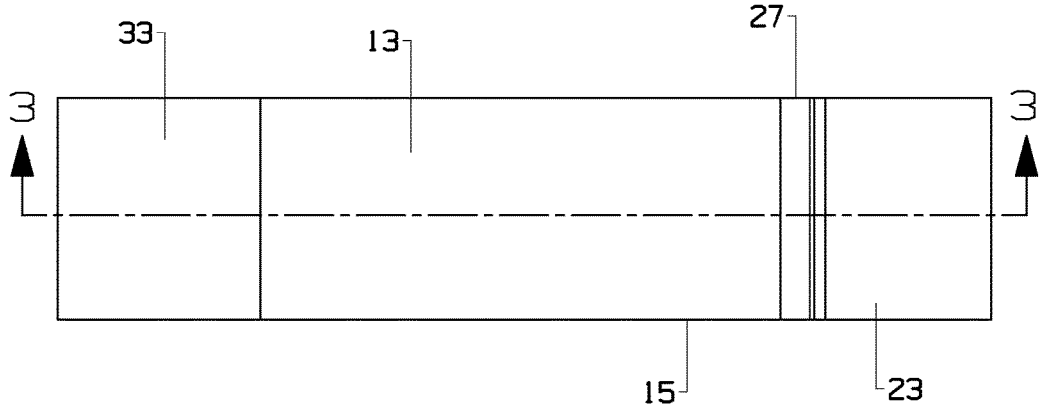
FIG. 2 is a top plan view of the flooring elements and subfloor of FIG. 1.
Figure 3:
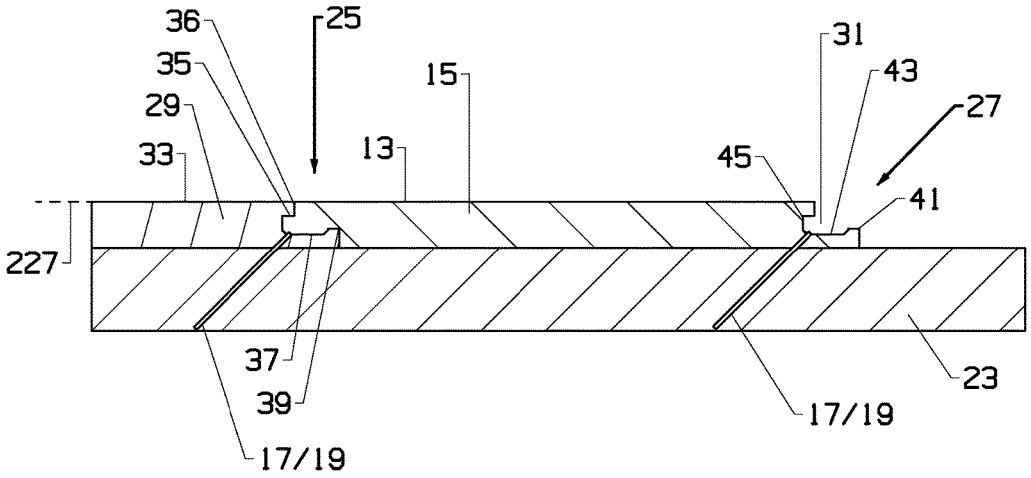
FIG. 3 is a section view of the flooring elements and subfloor taken along section 3-3 of FIG. 2.

FIGS. 1-3 illustrate that it can be important to drive the fastener 17 into the groove side 27 of the flooring element 15, particularly when securing snap-fit style flooring elements 15. In the snap-fit type flooring element 15 of FIGS. 1-3, tongue 29 and groove 31 have respective complex shapes keyed to snap, or interlock, together to hold flooring element 15 against an adjacent flooring element 33. In the example of FIGS. 1-3, tongue 29 is defined by top wall 35 and bottom wall 37 with upper recess 39 milled or provided in flooring element 15. Groove 31 is defined by upright rib 41, bottom wall 43 and top wall 45. It is apparent that when tongue 29 is received in groove 31, rib 41 is received in upper recess 39 to snap-fit, or interlock, flooring elements 15, 33 together. It is also apparent that it would not be possible to drive a fastener 17 into tongue side 25 of the snap-fit flooring element 15 for a blind fastening process because fastener 17 would extend beneath tongue 29 bottom wall to obstruct tongue 29 from being received in groove 31 of an adjacent flooring element 33.

Driving of a fastener 17 into groove side 27 of flooring element 15 with a conventional fastener-driving tool (not shown) that is supported on subfloor 23 next to flooring element 15 is problematic, however, because rib 41, or top and bottom walls 35, 37 defining groove 31 obstruct such a conventional fastener-driving tool from being positioned within groove 31 to drive the fastener 17. The result can be inconsistent fastener 17 placement at inconsistent angles relative to flooring element 15.

Support system 10 solves these and other problems by providing an adjustable support to position fastener-driving tool 11 for repeatable driving of fasteners 17 at a consistent position and angle on the tongue side 25 and/or the groove side 27 of flooring element 15. The support system 10 can be constructed to align the fastener-driving tool 11 at a 45° angle relative to subfloor 23. The support system 10 can position fastener-driving tool 11 to drive fastener 17 into a tongue side 25 "pocket" formed at the junction of the tongue 29 top wall 35 and vertical side wall 36 and also into groove side 27 bottom wall 43 within groove 31.

Referring then to FIGS. 5-14, a support system 10 may generally include a channel member 47, a base 49 and a holder mechanism 51. Support system 10 may also include a guide member 53.

Base 49 provides a stable platform for repeatable and consistent positioning of fastener-driving tool 11 on a top surface 13 of flooring element 15 during both positioning of fastener-driving tool 11 and during fastener 17 driving. Base 49 also enables repeatable fastener 17 driving at a consistent vertical position relative to flooring element 15 and at a consistent angle, which may be a 45° angle. In the examples, channel member 47 and base 49 slide axially, or translate, with respect to the other and such relative movement positions fastener-driving tool 11 in position to drive a fastener 17 at the desired position into flooring element 15. Holder mechanism releaseably holds channel member 47 and base 49 together with base 47 at a desired position along channel member 47.

Guide member 53 guides lateral movement of fastener-driving tool 11 along a flooring element 15 for positioning and re-positioning of fastener-driving tool 11 between driving cycles. Guide member 53 also facilitates repeatable positioning of fastener-driving tool 11 relative to flooring element 15 and stability during fastener 17 driving as described herein. Guide member 53 can also serve as a component of the fastener alignment and driving structure also as described below.

In the examples, channel member 47 is an elongate rigid structural member which may be a robust aluminum-material extrusion. Channel member 47 provides a rigid structural mount for guide member 53 and fastener driver 55. Channel member 47 generally serves as a support structure which directly or indirectly supports all components of fastener-driving tool 11. Channel member 47 of the examples includes a first or forward end 57 and a second or rearward end 59. Channel member 47 also defines an axis 61 which extends between forward and rearward ends 57, 59.

Channel member 47 includes an elongate magazine 63 coaxial with axis 61. Magazine 63 is in fastener-feeding relationship with driver 55 and is provided to feed a stick 64 of fasteners 17 (cleats 19 in the examples) to driver 55. FIGS. 4B and 4C illustrate side and perspective views of a representative stick 64 of cleats 19. Staples 21 can also be provided in a stick and fastener-driving tool 11 could drive such stick of staples 21 with appropriate modifications to the fastener-driving tool 11. In the examples, magazine 63 is bounded by elongate side wall 65 and top and bottom walls 67, 69 all coaxial or parallel with axis 61. Channel guide 71 provides a closure, or cover, of magazine 63 and slides axially toward, and alternatively away, from forward end 57 of channel member 47 in axial tracks 73, 75 provided in top and bottom walls 67, 69 to open magazine 63 for loading of a stick 64 of fasteners 17 in magazine 63 and to close magazine 63 for use of fastener-driving tool 11.

Channel guide 71 can be locked to close the magazine 63 for use of fastener-driving tool 11 with channel guide 71 toward forward end 57 by interaction of spring-biased lock 77 and lock plate 79 secured to channel guide 71 by machine screws 81, 83. Movement of lock 77 out of contact with lock plate 79 permits a user to push lock plate 79 away from forward end 57 to open magazine 63 for loading a stick 64 of fasteners 17 against side wall 65.

In the examples, a fastener pusher 85 within magazine 63 is provided to push the stick 64 of fasteners 17 loaded in magazine 63 toward forward end 57 for driving of the forwardmost fastener 17 by driver 55. Fastener pusher 85 is carried on channel guide 71 and is biased toward forward end 57 of channel member 47 by springs 87, 89 within a respective axial spring guide tube 91, 93 provided in channel guide 71. Fastener pusher 85 contacts rearwardmost fastener 17 of the stick 64 of fasteners 17 to push such fastener stick 64 in magazine 63 toward forward end 57 of channel member 47.

In the examples, magazine 63 delivers fasteners through forward end 57 of channel member 47 toward gate plate 95 and into a gate opening 97 defined by a surface of guide member 53 secured to and supported by channel member 47 as described below. Gate plate 95 includes a tip 99 for reasons described below.

In the examples, gate opening 97 is an axial opening entirely through guide member 53 closed at the forwardmost end by gate plate 95. Gate opening 97 is in fastener-feeding relationship with magazine 63 such that the forwardmost fastener 17 of the fastener stick 64 is received in gate opening 97 against gate plate 95 under force applied by springs 87, 89 acting on fastener pusher 85. When in gate opening 97, fastener 17 is in position for driving by a drive blade 149 of driver 55.

Guide member 53 and gate opening 97 lie in and define an axis 98 normal (i.e., perpendicular) to axis 61 of channel member 47. Drive blade 149 is in axial alignment with axis 98 and a fastener 17 in gate opening to drive the fastener 17. A fastener 17 pushed into gate opening 97 is, as a consequence, normal to axis 61 and is driven out of gate opening 97 and guide member 53 along axis 98.

In the examples, guide member 53 further defines a driving end fastener outlet 101 at a lower end of guide member 53 referred to herein as a support surface 109. Driving end fastener outlet 101 is in axial alignment with gate opening 97 and axis 98 in the examples. A fastener 17 in gate opening 97 is driven by driver 55 drive blade 149 out of driving end fastener outlet 101 and into flooring element 15 along axis 98 in a direction normal to axis 61 of channel member 47. Therefore, driving end fastener outlet 101 lies in and partially defines axis 98. The lower end support surface 109 of guide member 53 and driving end fastener outlet 101 define a driving end 103 of fastener-driving tool 11 in the examples.

Figure 5:
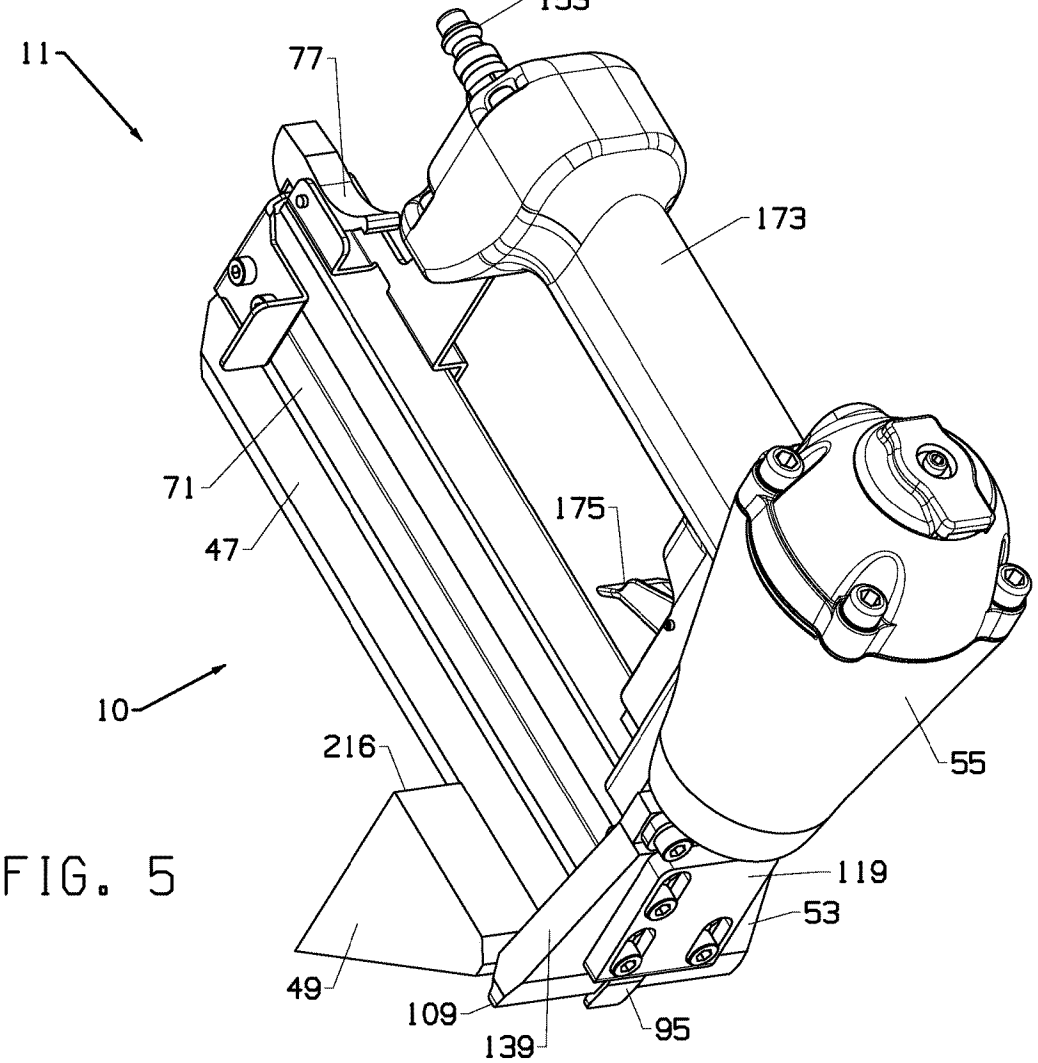
FIG. 5 is a front side perspective view of an embodiment of an adjustable fastener-driving tool support system according to the invention and a fastener driver supported thereon.
Figure 6:
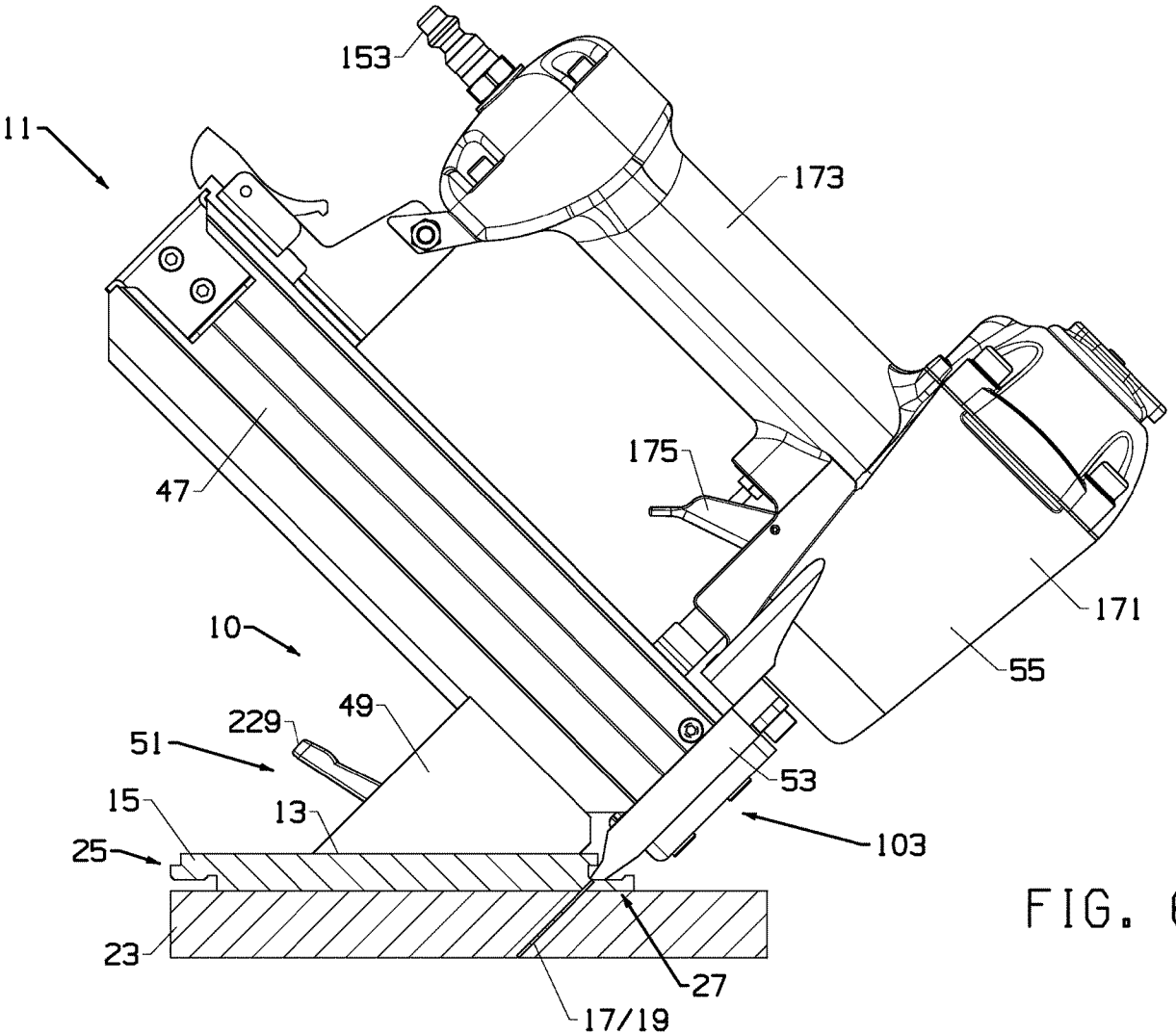
FIG. 6 is a side elevation view of the fastener-driving tool support system and fastener driver of FIG. 5 with the flooring elements and subfloor shown in section to facilitate understanding.
Figure 11:
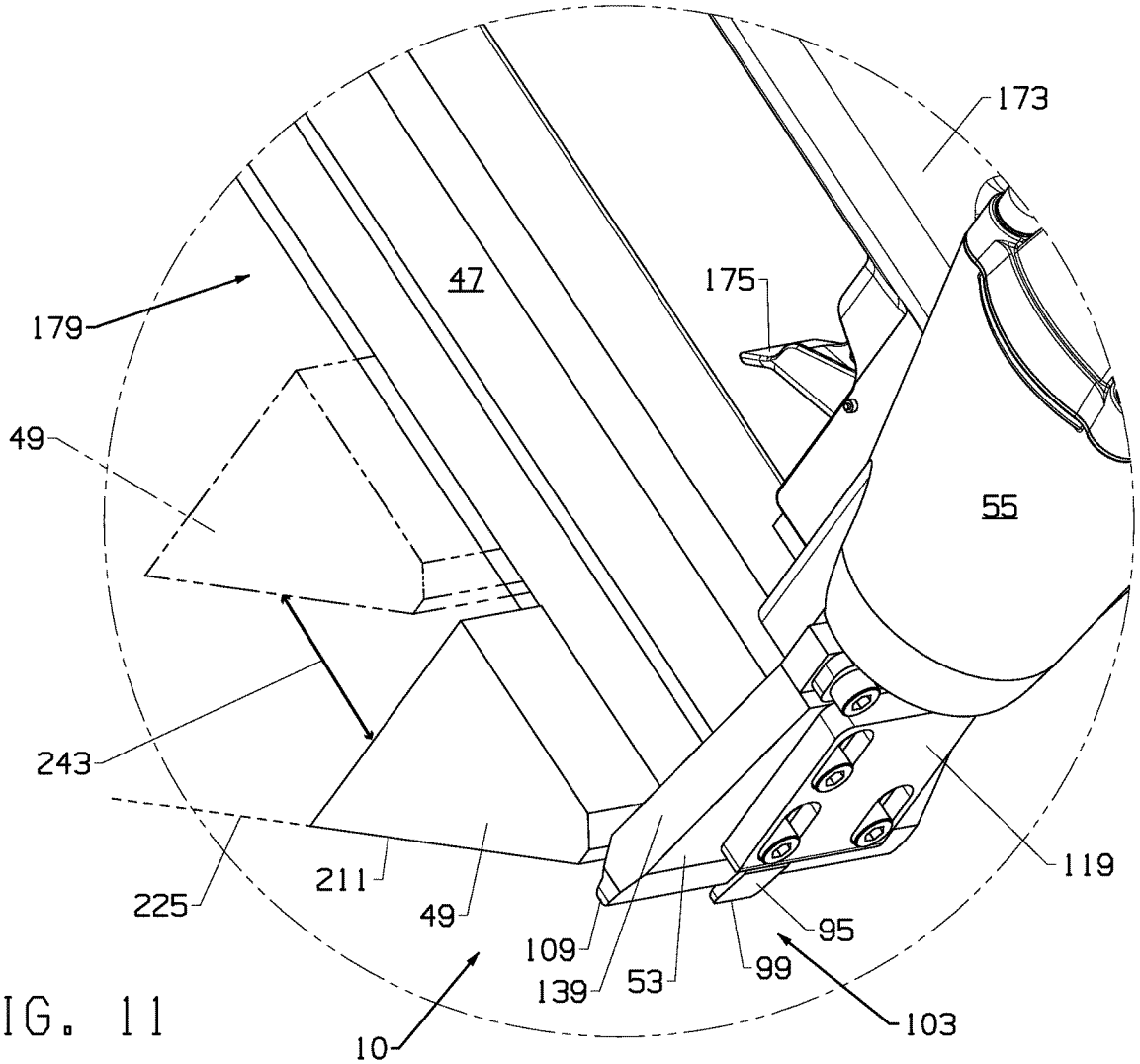
FIG. 11 is an enlarged perspective view showing relative axial movement of a channel member and base of the adjustable fastener-driving tool support system of FIG. 5.

Also in the examples, gate plate 95 translates in track 105 of guide member 53 along axis 98 normal to axis 61 between first and second positions. Such translating movement is used to actuate, or act on, a safety mechanism (not shown) which enables driver 55 for operation when tip 99 of gate plate 95 is in contact with a workpiece, such as flooring element 15. Gate plate 95 is biased away from driver 55 by a spring (not shown) of the safety mechanism to a first position in which tip 99 is spaced furthest from support surface 109. Gate plate 95 is connected to the safety mechanism through bracket 107. When gate plate 95 tip 99 is pressed against a flooring element 15 or other workpiece as illustrated in FIG. 6, gate plate 95 translates, or slides, in track 105 to a second position with tip 99 and that movement moves bracket 107 to operate the safety mechanism to enable driver 55 operation. Driver 55 is disabled when gate plate 95 is not in contact with a flooring element 15 or other workpiece as illustrated in FIGS. 5 and 11. When gate plate 95 tip 99 is pressed against flooring element 15, tip 99 and driving end fastener outlet 101 are aligned and flush with support surface 109 along a lower forward end of guide member 53.

Figure 8:
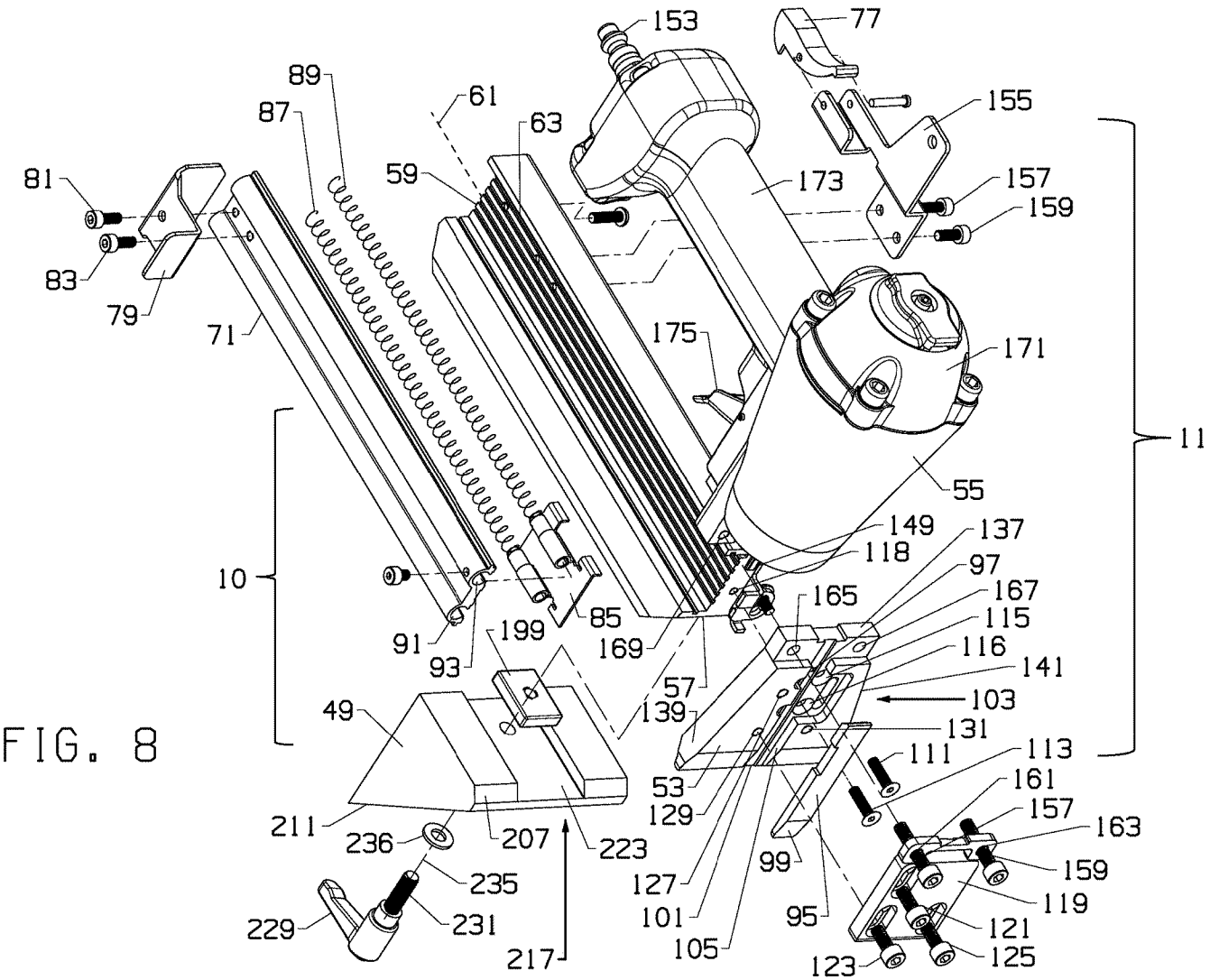
FIG. 8 is an exploded view of the fastener-driving tool support system and fastener driver of FIG. 5.
Figure 10:
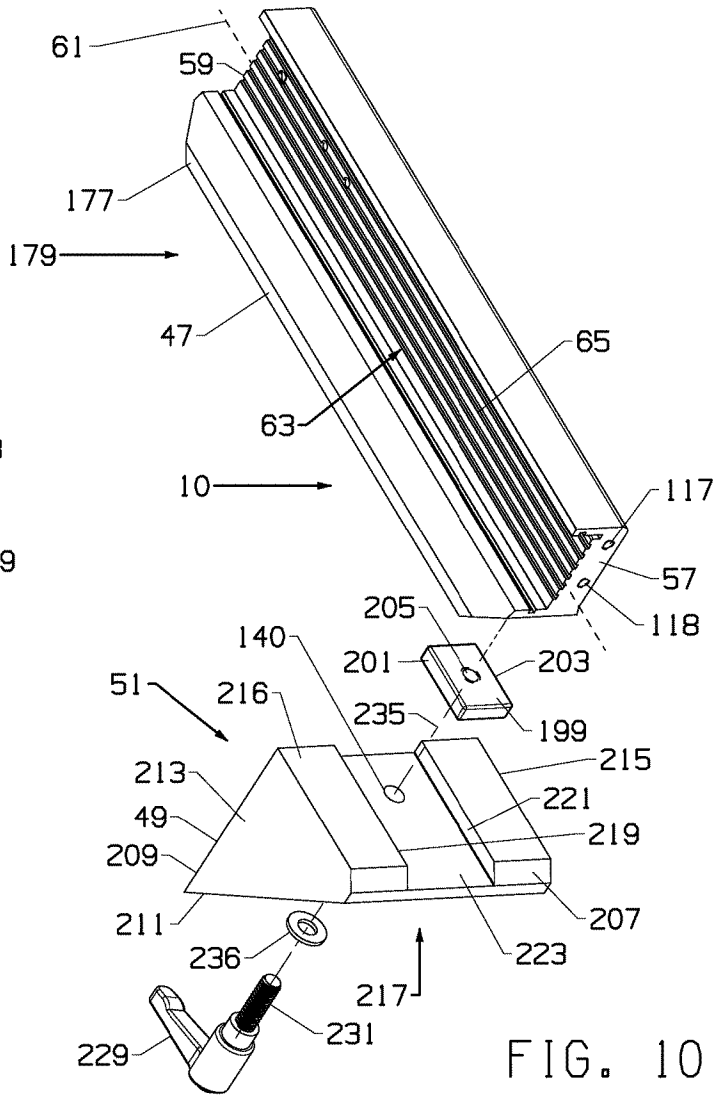
FIG. 10 is an exploded view of components of the adjustable fastener-driving tool support system of FIG. 5.

As illustrated in FIGS. 8 and 10, guide member 53 supporting gate plate 95 and including both gate opening 97 and driving end fastener outlet 101 may be fastened to forward end 57 of channel member 47 in fixed position by flat head screws 111, 113 inserted through guide member 53 openings 115, 116 and mated with corresponding threaded bores 117, 118 in forward end 57 of channel member 47. Accordingly, gate opening 97 and driving end fastener outlet 101 are supported by channel member 47 through guide member 53 secured to channel member 47.

Gate plate 95 is retained in track 105 by cover plate 119 held against guide member 53 by machine screws 121, 123, 125 mated with corresponding threaded bores 127, 129, 131 in guide member 53. Gate plate 95 and track 105 are sized so that gate plate 95 can translate, or slide, back-and-forth when cover plate 119 is secured against guide member 53 to operate the safety mechanism to enable operation of driver 55 as previously described.

As illustrated in FIGS. 5-8 and 11-14, guide member 53 includes structure which guides fastener-driving tool 11 for lateral sliding movement along flooring element 15 so that fastener-driving tool 11 can be rapidly positioned along flooring element 15 to drive fasteners 17 at a consistent position and angle. And, guide member 53 supports and positions fastener-driving tool 11 on flooring element 15 for fastener 17 driving.

In the examples, guide member 53 includes support surface 109 along a lower forward end of guide member 53 and driving end fastener outlet 101 may be defined by such support surface 109 and guide member 53 as previously described. Guide member 53 may further include top and bottom sides 133, 135, rear end 137 and lateral sides 139, 141 which preferably widen outward to terminate at support surface 109 distal from rear end 137.

Support surface 109 is designed to rest on a bottom wall 43 of groove side 27 of flooring element 15 or on a top wall 35 of tongue 29 on tongue side 25 of flooring element 15 to laterally stabilize fastener-driving tool 11 on flooring element 15 during fastener 17 driving, especially as a user presses fastener driving tool 11 against flooring element 15. This locates driving end fastener outlet 101 directly against the flooring element 15 at the desired position prior to fastener 17 driving. A widened support surface 109 is useful to provide lateral stability for fastener-driving tool 11, although other configurations, such as narrower support surfaces 109 between lateral sides 139, 141, are contemplated.

Support surface 109 is preferably a smooth flat surface so as to slide easily along flooring element 15 with minimal friction when fastener-driving tool 11 is moved laterally along flooring element 15 during positioning and re-positioning of fastener-driving tool 11 with respect to flooring element 15. It is to be understood that support system 10 may be adjusted so that surface 109 is either slightly spaced (e.g., about 0.0156 inch) from flooring element 15 before fastener 17 driving or resting directly against flooring element 15 as desired by the user and as described below.

Guide member 53 may be sized or tapered to allow support surface 109 and fastener driving outlet 101 to be positioned directly on and in contact with flooring element 15 and to avoid obstructions such as upright rib 41 present in snap-fit type flooring elements 15 and to avoid obstructions provided by bottom and top walls 43, 45 defining groove 31 which would otherwise interfere with or block contact between support surface 109 and flooring element 15. This enables fastener-driving tool 11 to drive a fastener 17 on either of the groove side 27 or the tongue side 25 of the flooring element 15.

In the examples of FIGS. 5-8 and 12-14, one or both of top and bottom sides 133, 135 may be tapered to narrow and reduce the thickness of guide member 53 between top and bottom sides 133, 135 proximate support surface 109. In the example, top side 133, of guide member 53 can be provided with first and second stepped surfaces 143, 145 which collectively provide a taper reducing the thickness of guide member 53 proximate support surface 109. Bottom side 135 may also include a taper 147, which may or may not be stepped, further reducing the thickness of guide member 53. The purpose of reducing the thickness of guide member 53 proximate support surface 109 is to enable support surface 109 and driving end fastener outlet 101 to fit within or around obstructions provided by flooring element 15, particularly on the groove side 27 of the flooring element 15, to support fastener-driving tool 11 on flooring element 15 and to precisely position driving end fastener outlet 101 for driving of fastener 17. The narrowed thickness of guide member 53 and support surface 109 is also useful to position support surface 109 on a tongue 29 top wall 37.

Guide member 53 could be provided without one or more taper. For example, guide member 53 could be of a generally uniform thickness between top and bottom sides 133, 135 with the thickness being sufficiently narrow to enable support surface 109 to clear obstructions of the types previously described and provided by flooring element 15. Guide member 53 may be a unitary part, for example, of a cast or machined rigid material.

In other embodiments, guide member 53 could function solely as a second point of support for fastener driving tool 11 against flooring element 15 and would not include gate opening 97 or driving end fastener outlet 101. In such embodiments, a separate fastened-together gate and gate plate (not shown) defining a gate outlet (e.g., an outlet like gate outlet 97) and a driving end fastener outlet (e.g., an outlet like outlet 101) could be secured to forward end 57 of channel member 47 to receive fasteners 17 from forward end 57 of magazine 63 in the same manner as described with gate opening 97 and gate plate 95 of guide member 53. In such embodiments, guide member 53 and support surface 109 could be positioned around such gate and gate plate (not shown) to rest on flooring element 15 as previously described in connection with guide member 53 and support surface 109. Also in such embodiments, driver 55 would drive a fastener 17 in such a gate outlet of gate and gate plate (not shown) and out through driving end fastener outlet defined by the gate and gate plate along an axis 98 in the same manner as previously described. Accordingly, a guide member 53 is not required. However, guide member 53 is highly desirable, particularly where two points of contact for the fastener-driving tool 11 against the flooring element 15 and where providing a fastener driving outlet 101 along support surface 109 are desired.

Driver 55 of the examples may be a pneumatic air-powered driver as illustrated in FIGS. 5-8 and 11. Other types of drivers 55, such as an electric driver, a combustion-type driver, a manual driver, or another driver type may be implemented. Driver 55 of FIGS. 5-8 and 11 may include an air-powered drive blade 149 axially aligned with fastener 17 in gate opening 97 which strikes a head 151 of a fastener 17 to drive fastener 17 out through driving end fastener outlet 101 along axis 98. A pressurized air source (not shown) delivers high pressure air to driver 55 through a hose (not shown) connected to air plug 153.

Driver 55 is rigidly secured to channel member 47 adjacent rearward end 59 of channel member 47 through bracket 155 and adjacent forward end 57 of channel member 47 closest to driving end 103 by machine screws 157, 159 through threaded cover openings 161, 163 and guide member 53 openings 165, 167 and into corresponding threaded bores, one of which is illustrated as bore 169 in driver housing 171 (the other bore is hidden in FIG. 8).

Handle 173 of driver 55 enables user gripping of fastener-driving tool 11. Trigger 175 is depressed to actuate driver 55 to drive a fastener 17. In the examples, contact of gate plate 95 tip 99 with flooring element 15 and translating movement of gate plate 95 and bracket 107 operates the safety mechanism (not shown) to enable trigger 175 for operation to actuate driver 55 as described previously.

Referring to FIGS. 5-11, channel member 47 of the examples provides components of support system 10, including components of holder mechanism 51. More specifically, a lower portion 177 of channel member, which may be widened (FIG. 9), provides a track 179. Track 179 is preferably coaxial or parallel with axis 61. In the example, track 179 may include side walls 181, 183 and bottom wall 185 of channel member 47 lower portion 177. Side and bottom walls 181, 183, 185 are all coaxial or parallel with axis 61. Side walls 181, 183 and bottom wall 185 cooperate with base 49 to provide relative axial sliding movement of channel member 47 and base 49 to raise and lower driving end fastener outlet 101 to position driving end 103 at the desired position relative to flooring element 15.

Figure 7:
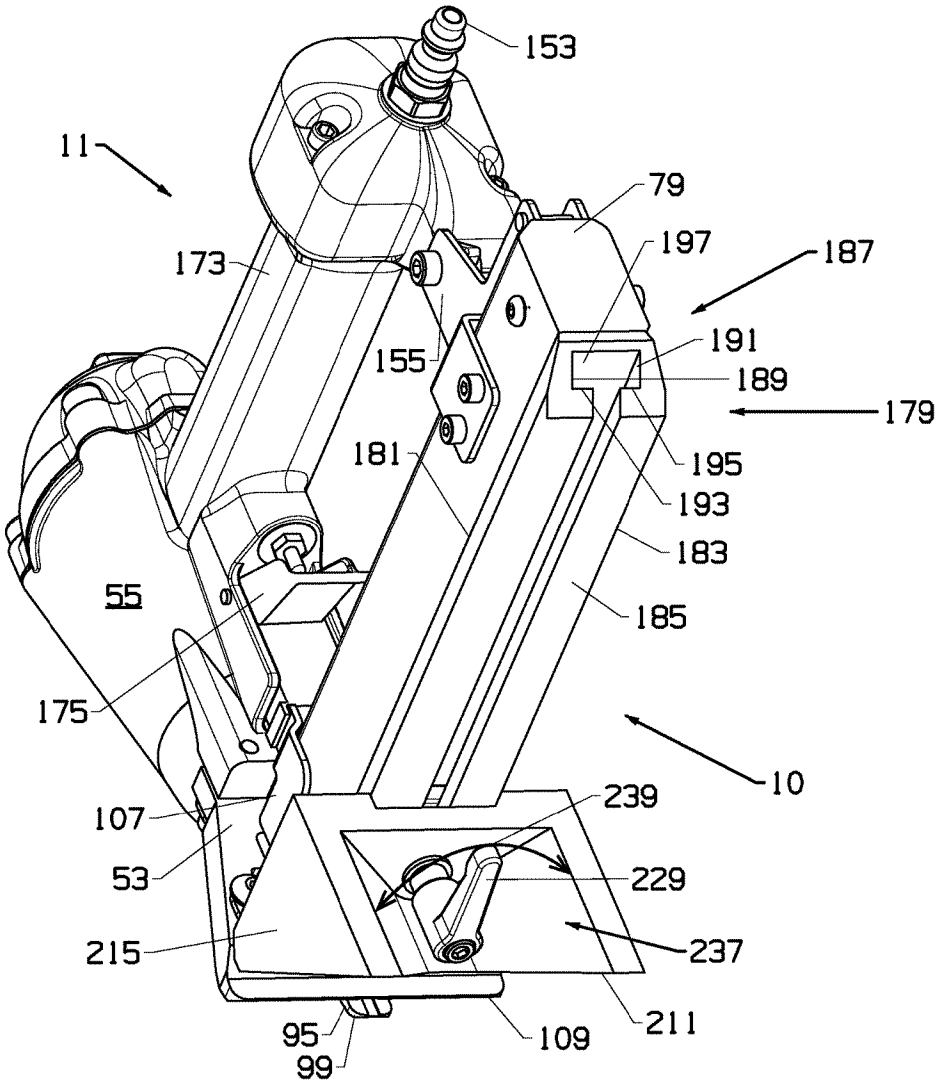
FIG. 7 is a rear side perspective view of the fastener-driving tool support system and fastener driver of FIG. 5.
Figure 9:
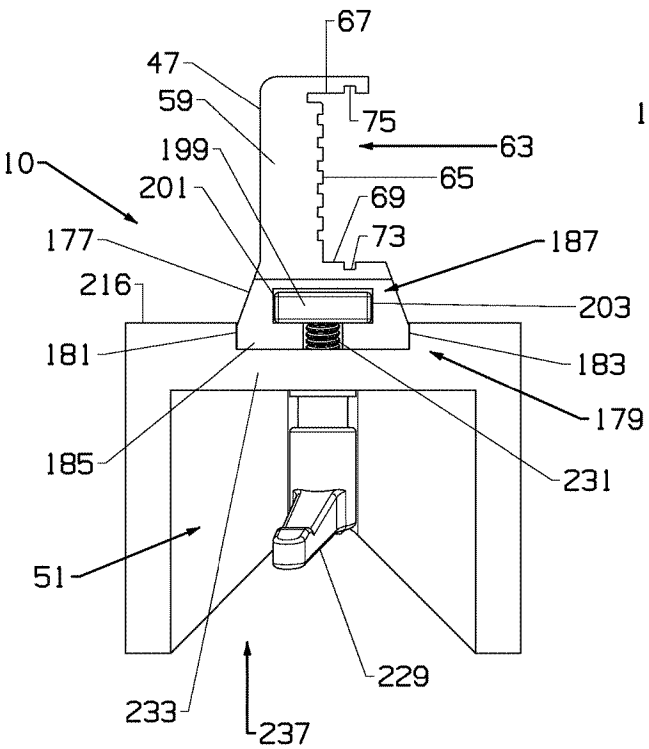
FIG. 9 is a rear side assembly view of components of the adjustable fastener-driving tool support system of FIG. 5.

Referring now to FIGS. 7-9, channel member 47 of the examples may further include an axial T-shaped track 187 provided as a component of holder mechanism 51. T-shaped track 187 illustrated in FIGS. 7 and 9 is preferably defined by parallel side walls 189, 191, spaced apart bottom walls 193, 195 and upper wall 197 all of which are coaxial or parallel with axis 61 in the examples. T-shaped track 187 is provided to receive retainer nut 199 of holder mechanism 51. Retainer nut 199 may be provided with parallel smooth flat (i.e., axial) outer edges 201, 203 and a threaded bore 205. Retainer nut 199 is sized for axial sliding movement within T-shaped track 187 toward and, alternatively, away from forward end 57 of channel member 47 for relative positioning and holding together of channel member 47 and base 49 as described herein. It is to be understood that T-shaped track 187 and the related components are merely one example of types of component that can be utilized to hold channel member 47 and base 49 together at a desired position.

Reference will now be made to FIGS. 5-14 and the examples of base 49 component of the support system 10 illustrated therein. In the examples, base 49 supports channel member 47 on a top surface 13 of flooring element 15. Base 49 as illustrated in FIGS. 5-14 has a generally wedge-shaped appearance for the purpose of supporting channel member 47 on a top surface 13 of flooring element 15 at a downward angle of about 45° so that fastener-driving tool 11 is positioned to drive a fastener 17 at about a 45° angle into flooring element 15 and subfloor 23 as illustrated in FIGS. 3, 6 and 12-14.

In the example, base 49 is provided with a first or forward end 207 toward forward end 57 of channel member 47 and driving end 103 of fastener-driving tool 11 and a second or rearward end 209 toward rearward end 59 of channel member 47. Base 49 preferably may have a generally smooth bottom surface 211 which is intended to rest on top surface 13 of flooring element 15 during use of fastener-driving tool 11 to drive a fastener 17 and during positioning and repositioning of fastener-driving tool 11 on top surface 13 of flooring element 15. In the examples, base 49 may also have parallel outer side walls 213, 215 and a top surface 216.

Referring to FIGS. 8-11 top surface 216 of base 49 includes engager structure 217 along top surface 216 to engage track 179. Top surface 216 of the examples is angled downward relative to base bottom surface 211 toward forward end 57 of channel member 47. Top surface 216 engages track 179 and enables the relative axial sliding movement of channel member 47 and base 49 to raise and lower driving end fastener outlet 101.

Top surface 216 of base 49 may include opposite inwardly-facing retainers 219, 221 and a support surface 223 defining a plane between retainers 219, 221. Top surface 216 support surface 223 and retainers 219, 221 comprise engager structure 217 in the examples. Retainers 219, 221 may be facing parallel planar walls normal to support surface 223 which is below retainers 219, 221 in the example. Retainers 219, 221 are spaced apart sufficiently to snugly, yet slidably, abut track 179 and channel member 47 sidewalls 181, 183 with channel member 47 bottom wall 185 resting on support surface 223 of top surface 216. Cooperation of retainers 219, 221 and sidewalls 181, 183 limits any significant non-axial relative movement of channel member 47 and base 49. Accordingly, channel member 47 and base 49 cooperate to provide relative axial sliding movement of channel member 47 and base 49.

The downward approximately 45° angle of channel member 47 is accomplished according to the examples by construction of base 49 top surface 216 with support surface 223 at the downward 45° angle toward base 49 forward end 207 and relative to base bottom surface 211. As a result, channel member 47 slidably supported on base 49 top surface 216 assumes a downward angle with axis 61 at approximately a 45° angle. The result is that a fastener 17 is driven by driver 55 at a 45° angle into flooring element 15 and subfloor 23 as illustrated in FIGS. 3, 6 and 12-14.

Also as a consequence of this structure, driving end fastener outlet 101 is supported by support system 10 at a position below a plane 225 defined by bottom surface 211 of base 49 as illustrated in the examples of FIGS. 5-7 and 11-14. When base 49 of fastener-driving tool 11 rests on top surface 13 of flooring element 15, driving end fastener outlet 101 and guide member 53 support surface 109 are below a plane 227 defined by top surface 13 of flooring element 15 as illustrated in FIGS. 3, 6 and 12-14. Guide member 53 support surface 109 can be positioned to overhang top surface 13 of flooring element 15 spaced slightly above flooring element tongue top wall 35 or bottom wall 43 of groove 31 or can rest in contact with such tongue top wall 35 or bottom wall surfaces 43. Because channel member 47 and base 49 can support driving end fastener outlet 101 and support surface 109 from above top surface 13 of flooring element 15, support system 10 enables driving end fastener outlet 101 to wrap around a top wall 45 of groove 31 to a position deep within groove 31 to avoid obstructions such as upright rib 41 or bottom and top walls 43, 45 defining groove 31 as described herein.

Relationships of channel member 47 and base 49 of support system 10 other than those illustrated herein are contemplated. For example, channel member 47 track 179 and base 49 top surface 216 could include engager structure 217 capable of engagement by means of a dove-tail-type joint with a widened dove-tail track 179 received in a corresponding set of retainers 219, 221. By way of further example, track 179 of channel member 47 could wrap around base outer side walls 213, 215. Such embodiments and others would permit the preferred relative axial movement of channel member 47 and base 49.

Base 49 may be made of any suitable material. For example, base 49 may be of acetal material or an ultra high molecular weight (UHMW) plastic. Such materials can be easily machined or cast to form the desired base 49 configuration. Metals and combinations of metals and plastics may be used. Bottom surface 211 of base 49 need not be smooth or planar but should not mar or damage flooring element 15 top surface 13. Acetal or UHMW materials would be suitable for bottom 211.

FIGS. 5-10 illustrate an example of a holder mechanism 51 which can be provided to releaseably hold base 49 at any one of a plurality of positions along channel 47. This, in turn, holds driving end fastener outlet 101 at a consistent vertical position relative to flooring element 15 for fastener 17 driving. In the examples, holder mechanism 51 provides a force which creates friction between base 49 and channel member 47 to hold base 49 and channel member 47 together to position driving end fastener outlet 101 at the desired height and position relative to flooring element 15.

In the examples, holder mechanism 51 includes T-shaped track 187, retainer nut 199, lever 229 with a threaded member 231 (i.e., a threaded machine screw), washer 235 and planar wall 233 of base 49. Lever 229 and threaded member 231 may be a single unitary part defining an axis 235. For example, threaded member 231 could include splines (not shown) firmly seated in a mount for lever 229. Lever 229 is normal to axis 235 and is pivotable about axis 235. As illustrated in FIGS. 7 and 9, base 49 defines a compartment 237 bounded by wall 233 and side walls 213, 215 which are spaced apart sufficiently to permit back-and-forth pivoting movement of lever 229 in the directions of dual-headed arrow 239 to apply and release a holding force. Lever 221 extends out of and beyond base 49 to a user-accessible position. Threaded member 231 is inserted through a hole 240 in wall 233. Threaded member 231 is inserted through washer 243 and threaded member 231 is meshed with retainer nut 199 which is within T-shaped track 187.

As illustrated in FIGS. 7 and 8-11, pivoting movement of lever 229 in the counter clockwise direction of arrow 239 applies a force through threaded member 231, wall 233, bottom walls 193, 195 of T-shaped track 187 and retainer nut 199. Interference between side walls 189, 191 of T-shaped track 187 and side edges 201, 203 of retainer nut 199 limit rotation of retainer nut 199 enabling rotation of threaded member 231 in bore 205 to apply the force and to pull channel member 47 bottom wall 185 and base 49 support surface 223 closely together. The force creates friction between bottom wall 185 of channel member 47 and support surface 223 of base 49 holding channel member 47 and base 49 tightly together without need for adjustment throughout the many fastener-driving cycles during a flooring installation.

Pivoting movement of lever 229 in the clockwise direction of arrow 239 lessens the force. The force may be lessened sufficiently to provide for the relative axial sliding movement of channel member 47 and base 49 as illustrated in FIG. 11. Relative movement of the channel member 47 and base 49 made possible by lessening the force, in turn, enables the user to change the position of driving end fastener outlet 101 relative to flooring element 15.

In operation, support system 10 may be used to position fastener-driving tool 11 to secure different types of flooring elements to a subfloor 23. To illustrate this versatility of support system 10, the fastener-driving tool 11 is separately described in use with an engineered flooring element 15 of a snap-fit type (FIGS. 1-3, 6, 12) as well as with both the tongue and groove sides of a conventional tongue-and-groove flooring element 241 (FIGS. 13-14).

Initially, channel member 47 magazine 63 is loaded with a stick 64 of fasteners 17. The fastener stick 64 is loaded in magazine 63 by pulling channel guide 71 rearwardly to open magazine 63 and placing the stick 64 into magazine 63. Channel guide 71 is pushed forward until engagement of lock 77 closes magazine 63. Fastener pusher 85 pushes stick 64 of fasteners 17 so that the forwardmost fastener 17 is in gate opening 97 of guide member 53. A pressurized air source may be connected to air plug 153 before or after loading of magazine 63.

Figure 12:
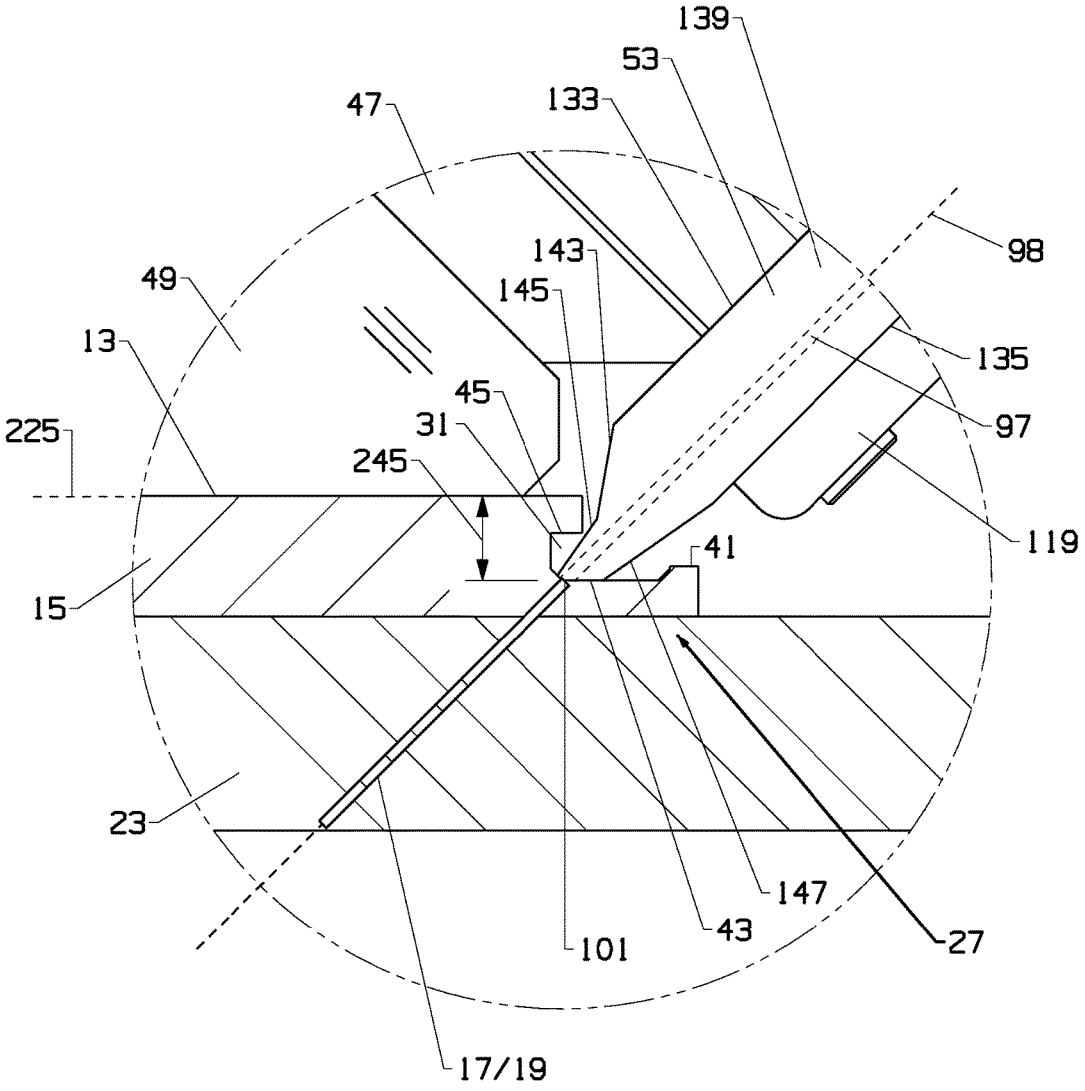
FIGS. 12-14 illustrate the capability of the adjustable fastener-driving tool support system of FIG. 5 to position a fastener-driving tool to repeatably drive fasteners at a consistent position and angle into the tongue side or the groove side of representative flooring elements.

Referring next to FIGS. 6 and 12, those figures illustrate use of support system 10 to position fastener-driving tool 11 with respect to a groove side 27 of a snap-fit flooring element 15. Initially, flooring element 15 is placed in the desired position on subfloor 23. Fastener-driving tool 11 is placed on top surface 13 of flooring element 15 with bottom surface 211 of base 49 resting on the top surface 13 and driving end 103 toward the groove side 27 of the flooring element 15 in this example.

Next, lever 229 (FIGS. 7-10) is pivoted in the clockwise direction of arrow 239 to lessen the force applied by holder mechanism 51 to permit relative axial sliding movement of channel member 47 and base 49. With base 49 resting on top surface 13, channel 47 can slide sufficiently to lower guide member 53 support surface 109 into resting contact with bottom wall 43 of flooring element 15. Alternatively, a user can adjust base 49 and channel member 47 so that support surface 109 is spaced slightly above bottom wall 43 of flooring element 15 in an overhanging relationship with top surface 13 of flooring element 15. A representative spacing may be about 0.0156 inch. The slight spacing is desirable to facilitate lateral movement of fastener-driving tool 11 along flooring element 15 with minimal friction between support surface 109 and bottom wall 43 of flooring element 15 during re-positioning of fastener-driving tool 11. Arrow 243 in FIG. 11 illustrates the directions of relative axial movement of channel member 41 and base 49 providing for vertical raising and lowering of driving end fastener outlet 101.

Because guide member 53, support surface 109 and driving end fastener outlet 101 are supported by and suspended from channel member 47 on top surface 13 of flooring element 15 above groove side 27 in the examples, support surface 109 can be lowered from above bottom wall 43 and between upper wall 45 defining groove 31 and upright rib 41 with support surface 109 resting on bottom wall 43 or spaced slightly above bottom wall 43. This locates driving end fastener outlet 101 either in abutment with bottom wall 43 of flooring element 15 or closely proximate bottom wall 43 and in position to drive a fastener 17 into flooring element groove 31.

This positioning is made possible because driving end fastener outlet 101 is below the plane 225 defined by the base bottom surface 211 and the plane 227 of the flooring element top surface 13 when fastener-driving tool 11 is in position to drive a fastener 17. In effect, driving end fastener outlet 101 and support surface are able to wrap around a top wall 45 of groove 31 to a position deep within groove 31 to avoid the obstructions provided by top wall 45 and upright rib 41. Such positioning from above would not be possible were fastener-driving tool 11 to be located to the side of flooring element 15 on subfloor 23 because upright rib 41 and/or top wall 45 would obstruct positioning of driving end fastener outlet 101 and support surface 109 of guide member 53.

Vertical arrow 245 of FIG. 12 illustrates a vertical distance at which support surface 109 can be located below top surface 13 of flooring element. 15. Support system 10 enables support surface 109 to be located at other vertical distances from top surface 13 of flooring element 15 as described below.

With bottom surface 211 of base 49 preferably flat against top surface 13 of flooring element 15 and support surface 109 of guide member 53 flat against or spaced slightly above bottom wall 43 of flooring element 15 groove side 27, the user next pivots lever 229 in the counter clockwise direction of arrow 239 such that holder mechanism 51 applies a force which holds channel member 47 and base 49 tightly together in a fixed position. Operation of holder mechanism 51 holds driving end fastener outlet 101 of gate plate 95 at a consistent vertical position for repeated fastener 17 driving. Contact between gate plate 95 tip 99 and bottom wall 43 of flooring element 15 with holder mechanism 51 holding channel member 47 and base 49 together causes movement of gate plate 95 and enablement of driver 55 by the safety mechanism as described previously.

It is expected that user pushing against handle 173 would push support surface 109 of guide member 53 and driving end fastener outlet 101 firmly against bottom wall 43 for the actual fastener 17 driving event. Contact between guide member 53 tapered surface 145 and flooring element 15 limits any sliding movement of fastener-driving tool 11 away from groove side 27 of flooring element 15 when a user grasps and pushes handle 173. For types of fastener-driving tools other than as illustrated, the user also typically pushes against the tool before fastener driving and such pushing would push support surface 109 against flooring element 15.

Base 49 and guide member 53 would provide two points of contact between fastener-driving tool 11 and flooring element 15 during the fastener 17 driving and would limit any movement of fastener-driving tool 11 away from the user so that the driving force from the driver 55 is transferred to the fastener 17 minimizing any kick back of the fastener-driving tool 11.

Pulling trigger 175 causes driver 55 to drive a fastener 17 at a 45° angle completely into flooring element 15 and subfloor 23 as illustrated in FIGS. 3 and 12. Fastener 17 will be hidden when the tongue 29 of the next flooring element is snap fit into the groove 31 of flooring element 15 as illustrated in FIGS. 1 and 2.

Fastener-driving tool 11 can then be moved laterally along flooring element 15 by the user to a new position along flooring element 15 for further fastener 17 driving. Bottom surface 211 of base 49 slides on top surface 13 of flooring element 15 and support surface 109 of guide member 53 slides on, or close to, bottom wall 43 of flooring element 15 during the repositioning. The fastener-driving process can then be repeated through any number of fastener-driving cycles.

Referring next to FIGS. 11 and 13-14, those figures illustrate that support system 10 can also be adapted to position fastener-driving tool 11 to drive a fastener 17 into either the groove side 247 or tongue side 249 of a conventional tongue-and-groove flooring element 241. Referring to FIG. 13, groove 251 within groove side 247 is defined by bottom wall 253 and top wall 255. As illustrated in FIG. 14, tongue 257 projecting from side wall 259 is defined by top wall 261 and bottom wall 263.

Referring then to the example of FIG. 13, holder mechanism 51 is operated in the same manner as described in connection with FIGS. 11-12 so that the force applied by holder mechanism 51 is lessened. With base 49 resting on top surface 265, channel 47 can slide sufficiently on base 49 to lower guide member 53 support surface 109 into resting contact with bottom wall 253 defining groove 251 of flooring element 241 or spaced slightly from bottom wall 253 (e.g., spaced about 0.0156 inch). Holder mechanism 51 is then operated by moving lever 229 in the counter clockwise direction of arrow 239 to apply the force holding channel member 47 and base 49 in a position of a plurality of positions.

Because guide member 53 illustrated in FIG. 13 is suspended from channel member 47 on top surface 265 of flooring element 241 above groove side 247, support surface 109 and driving end fastener outlet 101 of guide member 53 can be lowered from above and into contact with bottom wall 253. And, because support surface 109 of guide member 53 can overhang top wall 255 defining groove 251 from guide member 53 which is at about a 45° angle relative to top wall 255, support surface 109 and driving end fastener outlet 101 can be inserted into and at least partially within groove 251 with support surface 109 and driving end fastener outlet 101 resting on, or close to, bottom wall 253 defining groove 251.

As previously described, base 49 and guide member 53 provide two stable points of contact between fastener-driving tool 11 and flooring element 241 when the user grasps handle 173 and pushes against fastener-driving tool 11. Contact between guide member 53 tapered surface 145 and flooring element 241 limits any sliding movement of fastener-driving tool 11 away from groove side 247 of flooring element 241 when a user grasps and pushes handle 173. Driver 55 may then be operated to drive a fastener 17 into flooring element 241 and subfloor 267 at a consistent angle of about 45° as illustrated in the example of FIG. 13. Fastener-driving tool 11 may then be repeatably re-positioned laterally along groove side 247 of flooring element 241 for additional fastener-driving cycles.

Vertical arrow 269 illustrates that support surface 109 of guide member 53 can be spaced a vertical distance from top surface 265 of flooring element 241 different from the vertical distance illustrated by vertical arrow 245 of FIG. 12. A comparison of vertical arrows 243 and 269 and flooring elements 15 and 241 demonstrates that support system 10 permits a single fastener-driving tool 11 to be adjusted to drive a fastener 17 at a consistent angle with respect to different types and sizes of flooring elements of which flooring elements 15 and 241 are examples.

Referring finally to the example of FIG. 14, it can be seen that support system 10 enables a single fastener-driving tool 11 to also drive a fastener 17 into the tongue side 249 of flooring element 241. Operation of holder mechanism 51 to lessen the force by clockwise (arrow 239) pivoting movement of lever 229 allows relative sliding movement of channel member 47 and base 49 to lower guide member 53 support surface 109 into resting contact with top wall 255 of tongue 257 or to be spaced slightly from top wall 255. With channel member 47 and base 49 held in the desired position by holder mechanism 51, fastener 17 can be driven out from driving end fastener outlet 101 and into a "pocket" at the junction of top wall 261 of tongue 257 and side wall 259 at a consistent angle of about 45° relative to top flooring element top surface 265 and subfloor 267 securing flooring element 241 to subfloor 267. Fastener-driving tool 11 may then be re-positioned laterally along tongue side 249 of flooring element 241 for additional fastener-driving cycles in which the fasteners 17 are repeatably driven at the same position and angle.

A comparison of the length of vertical arrow 271 of FIG. 14 with vertical arrows 245 and 269, illustrates again that support system 10 enables a single fastener-driving tool 11 to be adjusted to drive fasteners 17 at a consistent angle with respect to different types and sizes of flooring elements exemplified by flooring elements 15 and 241.

Support system 10 may be made of robust materials to ensure reliable operation under the most rigorous conditions. Materials may be chosen for other useful characteristics. For example, advanced metals, carbon fiber and composite materials may be implemented to reduce weight and provide desired strength and other physical characteristics.

While the principles of this invention have been described in connection with specific embodiments, it should be understood clearly that these descriptions are made only by way of example and are not intended to limit the scope of the invention.

The invention claimed is:

1. An adjustable fastener-driving tool support system for supporting the tool on the top surface of a flooring element to repeatably drive fasteners at a consistent position and angle into either a tongue side or a groove side of the flooring element, the support system comprising:

an elongate channel member having forward and rearward ends and defining an axis from the forward end to the rearward end, the channel member supporting a fastener driver and a driving end fastener outlet proximate the forward end through which fasteners are driven by the fastener driver, the channel member further having an elongate magazine coaxial with the axis in fastener-feeding relationship with the fastener driver;

a base for supporting the tool on the flooring element, the base having a forward end toward the channel member forward end, a rearward end, a bottom surface defining a plane and a top surface angled downward relative to the bottom surface toward the base forward end, the base supporting the channel member at the downward angle with the driving end fastener outlet below the bottom surface plane, the base being axially movable to a plurality of axial positions along the channel member parallel to or coaxial with the axis to raise or lower the driving end fastener outlet with respect to the base bottom surface; and a holder mechanism releaseably holding the base against the channel member at any one of the plurality of axial positions, thereby holding the driving end fastener outlet at a position to drive the fasteners at the consistent position and angle.

2. The support system of claim 1 further including:

an axial track on the channel member; and an engager along the base top surface in engagement with the track.

3. The support system of claim 2 wherein the axial track includes first and second opposite outer sides of the channel member.

4. The support system of claim 3 wherein the engager includes a pair of spaced apart inwardly-facing retainers and a support surface therebetween supporting the channel member thereon, the inwardly-facing retainers limiting non-axial movement of the base along the channel member.

5. The support system of claim 4 wherein the base top surface supports the channel member with the axis at a downward angle of about 45 degrees.

6. The support system of claim 4 wherein the holder mechanism applies a force which holds the base at any one of the plurality of axial positions along the channel member.

7. The support system of claim 6 wherein the holder mechanism includes:

an axial elongate track along the channel member;

a retainer nut which slides axially within the elongate track;

a threaded member inserted through the support surface in meshed relationship with the retainer nut; and a lever which turns the threaded member in one direction to apply the force which holds the channel member tightly against the support surface and which turns the threaded member in an opposite direction to lessen the force to permit the axial movement of the base along the channel member.

8. The support system of claim 1 further including a guide member secured with respect to the channel member forward end, the guide member including a lower end with a support surface below the base bottom surface configured to rest on a tongue surface of the tongue side or a groove surface of the groove side to support the tool during fastener driving.

9. The support system of claim 8 wherein the guide member defines a gate opening into which fasteners are fed from the magazine, the gate opening being in axial alignment with a drive blade of the fastener driver and the driving end fastener outlet being a lower end of the gate opening defined by the guide member support surface.

10. The support system of claim 9 wherein the guide member, gate opening and driving end fastener outlet are in an axis normal to the channel member axis.

11. The support system of claim 10 further including a gate plate supported by the guide member which closes a forward end of the gate opening.

12. The support system of claim 11 wherein the gate plate moves between a first position extending past the guide member support surface and a second position in alignment with the guide member support surface such that movement to the second position acts on a safety mechanism.

13. The support system of claim 8 wherein the guide member has a bottom side and a top side defining a thickness dimension therebetween and the guide member is tapered proximate the guide member support surface to narrow the thickness dimension.

14. The support system of claim 13 wherein both the bottom side and the top side of the guide member are tapered proximate the support surface.

15. An adjustable fastener-driving tool support system for supporting the tool on the top surface of a flooring element to repeatably drive fasteners at a consistent position and angle into either a tongue side or a groove side of the flooring element, the support system comprising:

an elongate channel member having forward and rearward ends and defining an axis from the forward end to the rearward end, the channel member supporting a fastener driver and a driving end fastener outlet proximate the forward end through which fasteners are driven by the fastener driver, the channel member further having an elongate magazine coaxial with the axis in fastener-feeding relationship with the fastener driver;

a base for supporting the tool on the flooring element, the base having a forward end toward the channel member forward end, a rearward end, a bottom surface defining a plane and a top surface angled downward relative to the bottom surface toward the base forward end, the base supporting the channel member at the downward angle with the driving end fastener outlet below the bottom surface plane, the base being axially movable to a plurality of axial positions along the channel member parallel to or coaxial with the axis to raise or lower the driving end fastener outlet with respect to the base bottom surface;

a guide member for supporting the tool on the flooring element during fastener driving, the guide member being secured with respect to the channel member forward end and having a support surface below the base bottom surface configured to rest on a flooring element tongue on the tongue side or a groove surface on the groove side during fastener driving; and a holder mechanism releaseably holding the base against the channel member at any one of the plurality of axial positions, thereby holding the driving end fastener outlet and guide member at a position to drive the fasteners at the consistent position and angle.

16. The support system of claim 15 further including:

an axial track on the channel member; and an engager along the base top surface in engagement with the track.

17. The support system of claim 16 wherein the axial track includes first and second opposite outer sides of the channel member.

18. The support system of claim 17 wherein the engager includes a pair of spaced apart inwardly-facing retainers and a support surface therebetween supporting the channel member thereon, the inwardly-facing retainers limiting non-axial movement of the base along the channel member.

19. The support system of claim 18 wherein the holder mechanism applies a force which holds the base at any one of the plurality of axial positions along the channel member.

20. The support system of claim 19 wherein the holder mechanism includes:

an axial elongate track along the channel member;

a retainer nut which slides axially within the elongate track;

a threaded member inserted through the support surface in meshed relationship with the retainer nut; and a lever which turns the threaded member in one direction to apply the force which holds the channel member tightly against the support surface and which turns the threaded member in an opposite direction to lessen the force to permit the axial movement of the base along the channel member.

21. The support system of claim 15 wherein the guide member defines a gate opening into which fasteners are fed from the magazine, the gate opening being in axial alignment with a drive blade of the fastener driver and the driving end fastener outlet being a lower end of the gate opening defined by the guide member support surface.

22. The support system of claim 21 wherein the guide member, gate opening and driving end fastener outlet are in an axis normal to the channel member axis.

23. The support system of claim 22 further including a gate plate supported by the guide member which closes a forward end of the gate opening.

24. The support system of claim 23 wherein the gate plate moves between a first position extending past the guide member support surface and a second position in alignment with the guide member support surface such that movement to the second position acts on a safety mechanism.

25. The support system of claim 22 wherein the guide member has a bottom side and a top side defining a thickness dimension therebetween and the guide member is tapered proximate the guide member support surface to narrow the thickness dimension.

26. The support system of claim 25 wherein both the bottom side and the top side of the guide member are tapered proximate the support surface.

* * * * *